US005584785A

United States Patent [19]

Wu

[11] Patent Number: 5,584,785

[45] Date of Patent: Dec. 17, 1996

[54] FOLDABLE HORSE RIDING EXERCISER

[76] Inventor: Tien-Lai Wu, No. 34-8, Lane 2, Yu Der Road, North Dist., Taichung, Taiwan

[21] Appl. No.: 661,232

[22] Filed: Mar. 1, 1996

[51] Int. Cl.[6] ..... A63B 69/06

[52] U.S. Cl. ..... 482/95; 482/96; 482/72; 482/57

[58] Field of Search ..... 482/95, 96, 57, 482/111, 148, 72, 71, 51; 472/106, 110

[56] References Cited

U.S. PATENT DOCUMENTS

| | | | |
|---|---|---|---|
| 5,458,553 | 10/1995 | Wu | 482/95 |
| 5,464,378 | 11/1995 | Yu | 482/95 |
| 5,533,953 | 7/1996 | Lui et al. | 482/95 |

OTHER PUBLICATIONS

Manual/Guthy–Renker Fitness Rower Rider Jan. 1996.

*Primary Examiner*—Jerome Donnelly
*Attorney, Agent, or Firm*—Charles E. Baxley, Esq.

[57] ABSTRACT

A horse riding exerciser includes an inclined beam and a post has a front end pivotally coupled to the beam. The post has a seat cushion secured to the rear end. A bar has a lower portion pivotally coupled to the front end of the beam at a pivot pin and includes two brackets secured above and below the pivot pin. A lever couples the post to either of the upper and the lower brackets. The seat cushion may be elevated when the front end of the lever is coupled to the lower bracket and when the bar is rotated toward the seat cushion, and when the front end of the lever is coupled to the upper bracket and when the bar is pushed away from the seat cushion.

1 Claim, 5 Drawing Sheets

FOLDABLE HORSE RIDING EXERCISER

BACKGROUND OF THE INVENTION

1. Field of the Invention

The present invention relates to an exerciser, and more particularly to a foldable horse riding exerciser.

2. Description of the Prior Art

Four conventional horse riding exercisers have been developed and are disclosed in U.S. Pat. No. 5,342,269 to Huang et al. issued Aug. 30, 1994; U.S. Pat. No. 5,356,357 to Wang et al. issued Oct. 18, 1994; U.S. Pat. No. 5,356,358 to Chen issued Oct. 18, 1994; and U.S. Pat. No. 5,366,428 to Liao issued Nov. 22, 1994. However, the typical horse riding exercisers are not foldable and comprise a huge volume which is adverse for transportation and storing purposes.

The present invention has arisen to mitigate and/or obviate the afore-described disadvantages of the conventional horse riding exercisers.

SUMMARY OF THE INVENTION

The primary objective of the present invention is to provide a foldable horse riding exerciser which may be folded to a compact configuration.

In accordance with one aspect of the invention, there is provided a horse riding exerciser comprising a beam including a lower and rear end and including an upper and front end having an extension extended therefrom, and including a middle portion and a rear portion, a leg including an upper and rear end pivotally coupled to the middle portion of the beam at a pivot shaft, the leg being rotatable about the pivot shaft to engage with the beam so as to form a folded configuration, a post including a front end pivotally coupled to the middle portion of the beam at a spindle and including a rear end having a seat cushion secured thereto, the post including a front portion having a pivot axle provided therein, a support secured in the rear portion of the beam so as to support the post at a horizontal position, means for applying a resistance force against the post, a pole including an upper end pivotally coupled to the upper and front end of the beam, and including a lower end having a foot support means secured thereto for supporting legs of a user, the pole including an upper portion located close to the upper end thereof, a link means pivotally coupled between the pivot axle and the upper portion of the pole so as to couple the pole to the post, a bar including a lower portion pivotally coupled to the extension at a pivot pin and including a handle secured on top thereof, the bar including an upper bracket and a lower bracket secured to the lower portion and arranged above and below the pivot pin respectively, and a lever including a rear end pivotally coupled to the pivot axle and including a front end adapted to be pivotally coupled to the upper and the lower brackets. The post is forced to rotate about the spindle by the lever so as to elevate the seat cushion when the front end of the lever is coupled to the lower bracket and when the handle is pulled toward the seat cushion, and the post is forced to rotate about the spindle by the lever so as to elevate the seat cushion when the front end of the lever is coupled to the upper bracket and when the handle is pushed away from the seat cushion.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
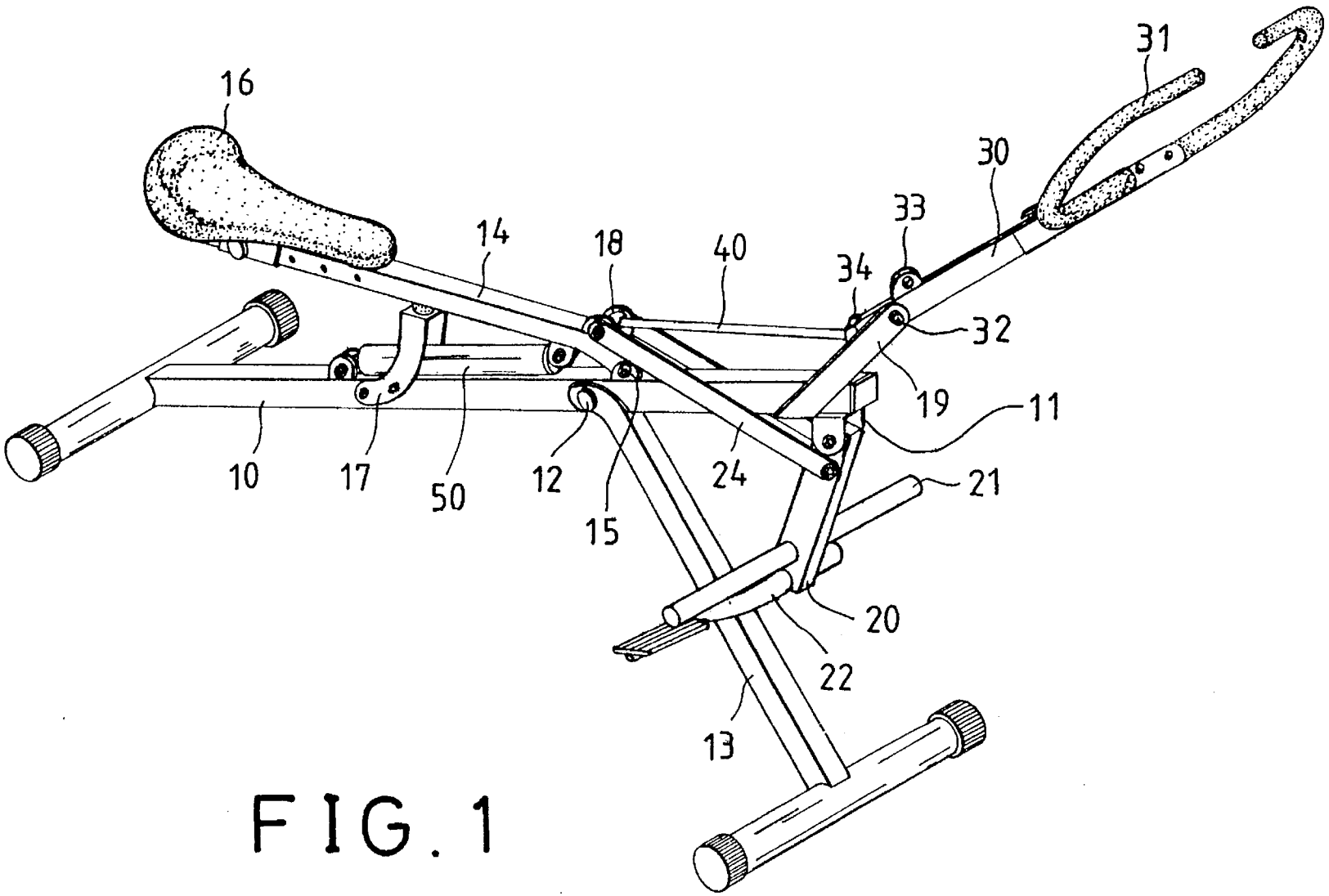
FIG. 1 is a perspective view of a foldable horse riding exerciser in accordance with the present invention.
Figure 2:
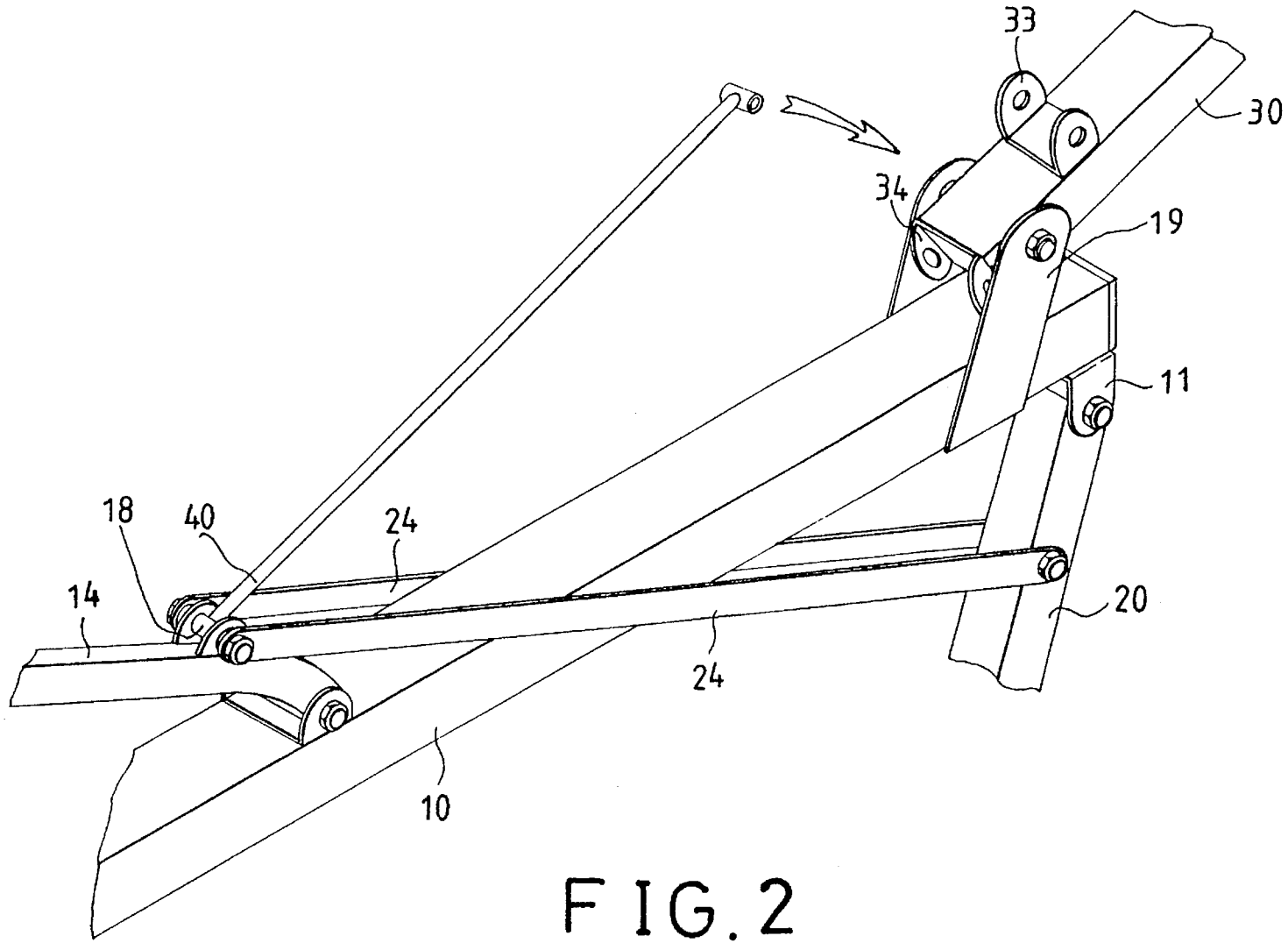
FIG. 2 is an enlarged partial perspective view of the foldable horse riding exerciser.

Referring to the drawings, and initially to FIGS. 1 and 2, a foldable horse riding exerciser in accordance with the present invention comprises a beam 10 arranged inclinedly having a lower and rear end and having an upper and front end which includes a bracket 11 secured thereto. A leg 13 includes an upper end pivotally coupled to the middle portion of the beam 10 by a pivot shaft 12 and arranged to support the beam 10 in the inclined position. The leg 13 may be folded clockwise about the pivot shaft 12 to engage with the beam 10 (FIG. 5) so as to form a folded configuration. A post 14 includes a front end pivotally coupled to the middle portion of the beam 10 at a spindle 15 and includes a seat cushion 16 secured to the rear and upper end thereof. A support 17 is secured in the rear portion of the beam 10 so as to support the post 14 at a horizontal position. The post 14 includes a pivot axle 18 provided in the front portion thereof. The beam 10 includes an extension 19 extended from the front end thereof. An actuator 50 is coupled between the post 14 and the beam 10 for applying a resistance force against the post 14.

A pole 20 includes an upper end pivotally coupled to the bracket 11 and includes a lower end having a foot support 22 and a rod 21 secured thereto for supporting the legs of the user. A pair of links 24 are pivotally coupled between the pivot axle 18 and the upper portion of the pole 20. A bar 30 includes a lower portion pivotally coupled to the extension 19 at a pivot pin 32 and includes a handle 31 secured on top thereof. An upper bracket 33 and a lower bracket 34 are secured to the bar 30 and are arranged above and below the pivot pin 32 respectively. A lever 40 includes a rear end pivotally coupled to the pivot axle 18 and includes a front end for pivotally coupling to either of the brackets 33, 34, best shown in FIG. 2.

Figure 3:
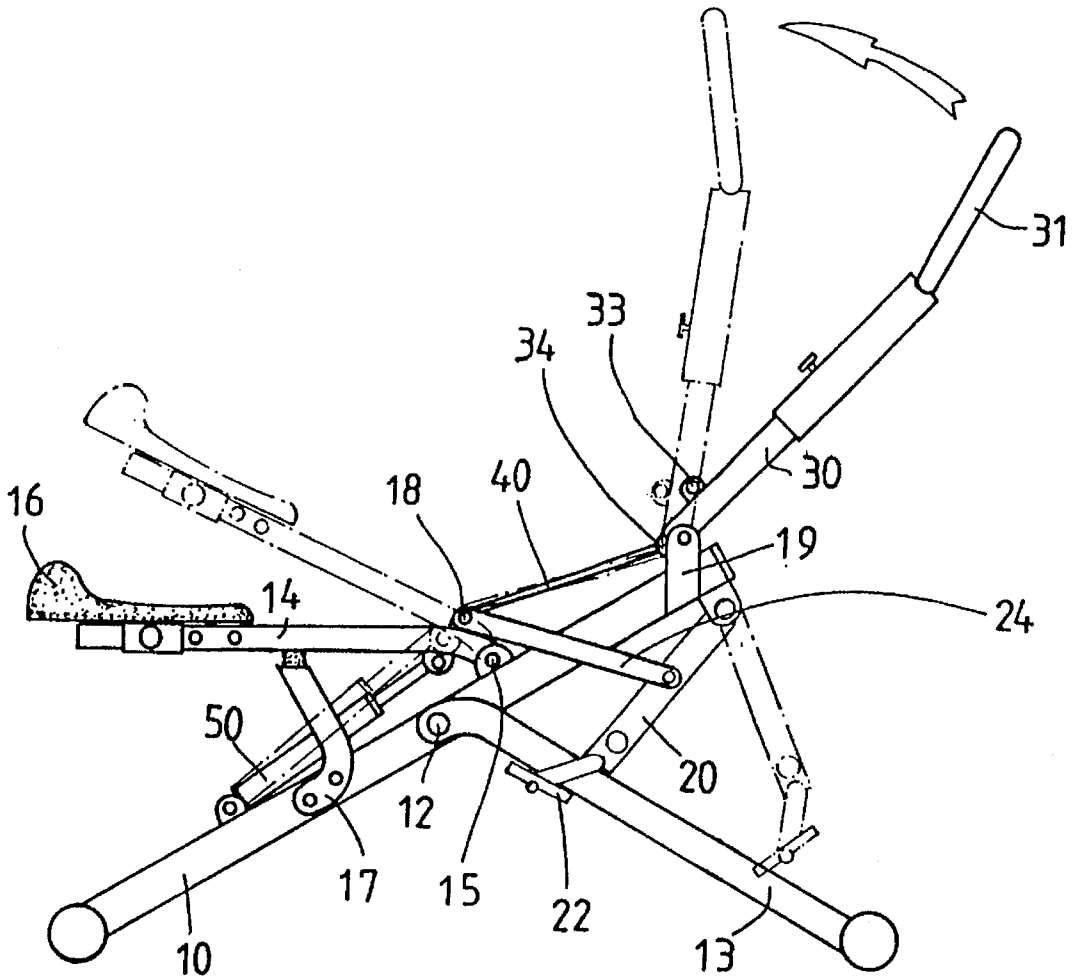
FIGS. 3, 4 and 5 are side views illustrating the operation of the foldable horse riding exerciser.

Referring next to FIG. 3, when the front end of the lever 40 is coupled to the lower bracket 34 and when the handle 31 is pulled counterclockwise, the post 14 may be forced to rotate clockwise about the spindle 15 by the lever 40 such that the seat cushion 16 may be elevated. The actuator 50 may apply a resistant force against the post 14 so as to resist the rotational movement of the post 14. The user thus should spend greater strength to overcome the resistant force of the actuator 50. The pole 20 may be caused to rotate counterclockwise by the link 24 when the post 14 rotates clockwise.

Figure 4:
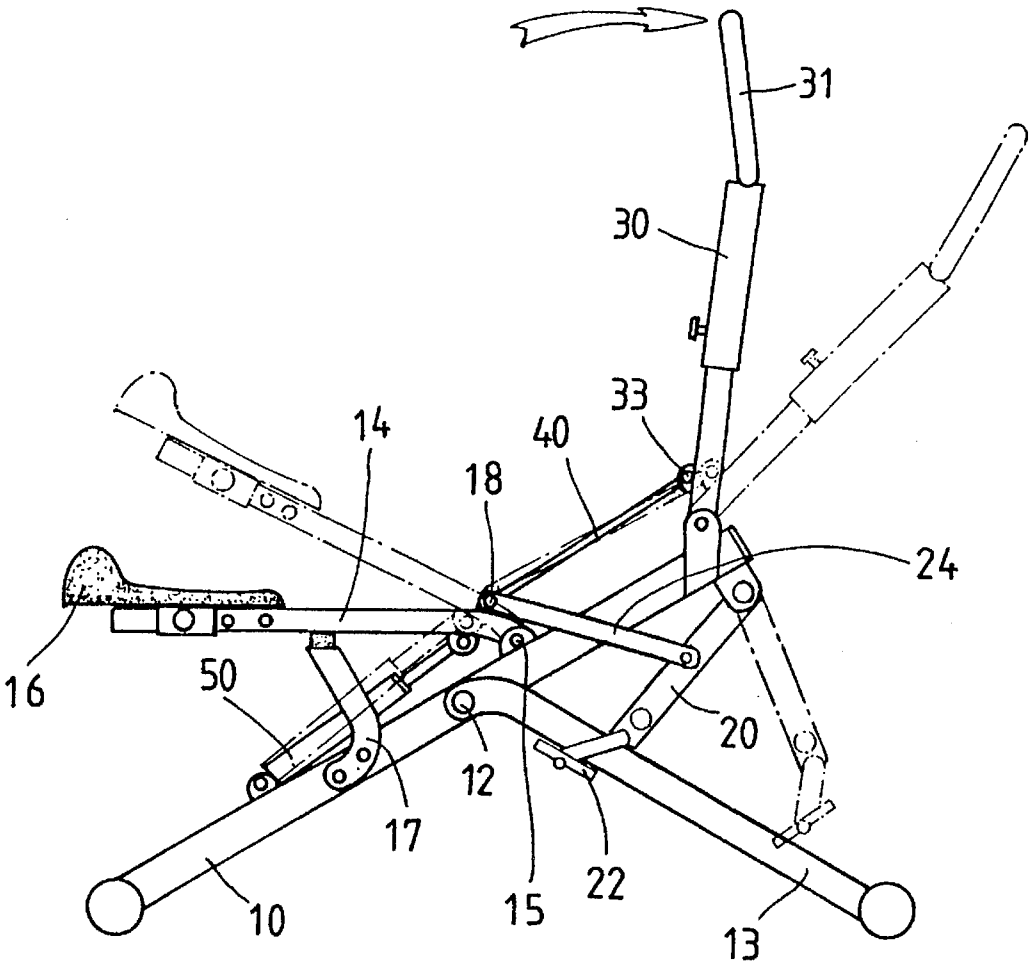

Referring next to FIG. 4, when the front end of the lever 40 is coupled to the upper bracket 33 and when the handle 31 is pushed to rotate clockwise, the post 14 may be forced to rotate clockwise about the spindle 15 by the lever 40 such that the seat cushion 16 may be elevated. The actuator 50 may also apply a resistant force against the post 14 so as to resist the rotational movement of the post 14. The user thus should spend greater strength to overcome the resistant force of the actuator 50. The pole 20 may also be caused to rotate counterclockwise by the link 24 when the post 14 rotates clockwise.

Figure 5:
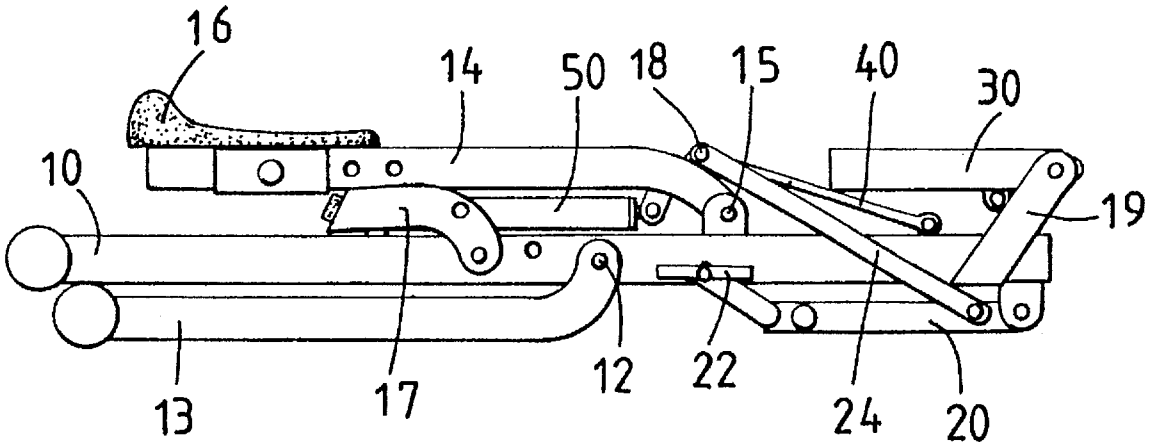

Referring next to FIG. 5, when the support 17 is rotated to engage with the beam 10 and when the leg 13 is folded clockwise about the pivot shaft 12 to engage with the beam 10 so as to form a folded configuration, and when the front end of the lever 40 is disengaged from both of the brackets 33, 34, the exerciser may be folded to a compact configuration which is excellent for transportation and storing purposes. The bar 30 may 0 include an upper part which may be disengaged from the lower part of the bar 30 such that the lower part of the bar 30 may be folded to the position as shown in FIG. 5. The upper part is provided for supporting the handle 31.

Accordingly, the foldable horse riding exerciser in accordance with the present invention may be folded to a compact configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A horse riding exerciser comprising:

a beam including a lower and rear end and including an upper and front end having an extension extended therefrom, and including a middle portion and a rear portion, a leg including an upper and rear end pivotally coupled to said middle portion of said beam at a pivot shaft, said leg being rotatable about said pivot shaft to engage with said beam so as to form a folded configuration, a post including a front end pivotally coupled to said middle portion of said beam at a spindle and including a rear end having a seat cushion secured thereto, said post including a front portion having a pivot axle provided therein, a support secured in said rear portion of said beam so as to support said post at a horizontal position, means for applying a resistance force against said post, a pole including an upper end pivotally coupled to said upper and front end of said beam, and including a lower end having a foot support means secured thereto for supporting legs of a user, said pole including an upper portion located close to said upper end thereof, a link means pivotally coupled between said pivot axle and said upper portion of said pole so as to couple said pole to said post, a bar including a lower portion pivotally coupled to said extension at a pivot pin and including a handle secured on top thereof, said bar including an upper bracket and a lower bracket secured to said lower portion and arranged above and below said pivot pin respectively, and a lever including a rear end pivotally coupled to said pivot axle and including a front end adapted to be pivotally coupled to said upper and said lower brackets, said post being forced to rotate about said spindle by said lever so as to elevate said seat cushion when said front end of said lever is coupled to said lower bracket and when said handle is pulled toward said seat cushion, and said post being forced to rotate about said spindle by said lever so as to elevate said seat cushion when said front end of said lever is coupled to said upper bracket and when said handle is pushed away from said seat cushion.

* * * * *